United States Patent [19]

Clendenin

[11] 4,450,654

[45] May 29, 1984

[54] PASSIVE DIVERSIONARY FLUID COLLECTING AND DEBRIS SEPARATING APPARATUS

[76] Inventor: Joseph G. Clendenin, 3475 Ridgeview Dr., Santa Rosa, Calif. 95404

[21] Appl. No.: 340,475

[22] Filed: Jan. 18, 1982

[51] Int. Cl.[2] ..... E04D 13/06; E04D 13/08

[52] U.S. Cl. ..... 52/12

[58] Field of Search ..... 52/12, 11, 16; 210/247, 210/153, 155, 162

[56] References Cited

U.S. PATENT DOCUMENTS

| | | | |
|---|---|---|---|
| 603,611 | 5/1898 | Nye . | |
| 836,012 | 11/1906 | Cassen . | |
| 891,405 | 6/1908 | Cassens . | |
| 1,575,991 | 3/1926 | Heller | 210/162 |
| 2,175,138 | 10/1939 | Westlake | 52/12 |
| 2,669,950 | 2/1954 | Bartholomew . | |
| 2,672,832 | 3/1954 | Goetz . | |
| 2,851,969 | 9/1958 | Teutsch . | |
| 3,367,070 | 2/1968 | Mitchell . | |
| 3,388,555 | 6/1968 | Foster . | |
| 4,411,110 | 10/1983 | Carey | 52/12 |

*Primary Examiner*—John E. Murtagh

*Attorney, Agent, or Firm*—Limbach, Limbach & Sutton

[57] ABSTRACT

The present invention is a passive diversionary fluid collecting and debris separating apparatus consisting of a surface having an opening and the opening has a first and second downwardly extending fin disposed at an upper and lower edge respectively for channeling fluid for collection, downwardly extending intermediate fins for channeling fluid for collection disposed between and with means connected to said first and second fins and a membrane disposed across the opening for separating debris from the fluid.

6 Claims, 8 Drawing Figures

PASSIVE DIVERSIONARY FLUID COLLECTING AND DEBRIS SEPARATING APPARATUS

BACKGROUND OF THE INVENTION

In the past, there have been various methods to separate fluids from debris contained therein. The apparatuses of the past can generally be termed as conventional filtering type apparatuses. There are a myriad of uses for fluid collecting and debris separation apparatuses. The uses vary from the ability to filter out very fine particles dispersed in the fluid to removal of large objects contained in the fluid. The application of fluid collecting and debris separating apparatuses has been found in nonclogging eaves trough or gutter systems and in downflow (gravity) filtering structures.

In the past, the principle active portion of the apparatuses has been some type of conventional filter in which the fluid containing the debris would pass through the filter and the debris would be held by the filter and the fluid would pass through the filter. However various problems were experienced in using this type of apparatus simply because there is always a tendency for the filter material to be clogged with debris.

In the application of a fluid collecting and debris separating apparatus to non-clogging eaves troughs or gutter systems the same principle is used. In such systems, water passed from a roof into a water collection area and the debris would be filtered or removed by the apparatus. However, even in many cases where this type of structure was used, there was a tendency for the apparatus to clog. If the apparatus was effective in preventing clogging it was ineffective to prevent the ingress of debris washed from the roof into the fluid collection area.

Various structures have been devised to separate fluid washing from a roof from a debris contained with the fluid, however, in most cases there was still a problem with clogging or the improper ingress of debris into the fluid collection area. The various types of structures of the past are represented by U.S. Pat. Nos. 603,611; 836,012; 891,045; 2,669,950; 2,672,832; 2,851,969; 3,367,070 and 3,388,555. Additionally, the structures, as disclosed in the above cited patents, did not have the ability to use varying types of access ports for the fluid to enter the collection area. These structures could not be used for the debris of different sizes washed from the roof toward the eaves troughs or gutter system.

These known problems associated with non-clogging eaves trough or gutters have continually presented problems to the owner of the structure employing them. The owner wanted to collect the water runoff from the roof because over a period of time water falling from the roof could erode the soil around the foundation of the structure. When the previous apparatuses were used they still had a tendency to clog and the owner would have to clean the system frequently to insure that debris was cleared off the ingress ports of the eaves trough or gutter structure.

In the past, down flow filtering systems used a characteristic method of gravity drip for passing fluid through the filter and trapping debris in the filter. However, as specified above, the filter tended to readily clog and frequent changes or cleaning of the filter were necessary. The necessity of continually changing the conventional types of filter made filtering over a long period of time very, time consuming due to the constant need for changing or cleaning of the filter. This changing of the filter was generally a physical act, namely manually changing the filter. In most cases, there was not the ability to rapidly change the filter in down flow filtering systems which was efficient for the user.

The existence of the problem to rapidly change or clean the filtering surface was also experienced in situations where a filtering structure was used in conjunction with a non-clogging eaves trough or gutter system.

The present invention in this application overcomes the problems of the past set forth above.

SUMMARY OF THE INVENTION

The present invention is a passive fluid collecting and debris separating apparatus. There are two embodiments of apparatus. The basic elements of the first and primary embodiment of the apparatus is a vertical surface having an elongated lateral opening therein disposed where there is a fin disposed from the upper edge of the opening, a fin disposed from the lower edge of the opening where the fin at the upper edge forms an obtuse angle with the surface and the fin at the lower edge forms an acute angle with the surface. In the primary embodiment there are also intermediate fins disposed in the opening between the fins disposed at the upper and lower edges of the opening. Disposed across the opening, in the primary embodiment, is a membrane. The basic elements of the second embodiment of the apparatus are a vertical surface having at least one elongated opening therein disposed with fins at the upper edge and lower edge of the laterally disposed openings and a membrane is disposed across the openings.

The membrane mentioned above can vary in permeability to be able to separate various types of debris having various sizes from the fluid to be collected The membrane can be mesh or a porous type surface or other structure of the like.

By the variance in the permeability of the membrane across the opening or openings, the amount of fluid used to flush and clean debris from the surface can be varied. Since the amount of fluid can be so varied, the membrane can be changed to accomplish the flushing of different types of debris from the surface of the apparatus.

In the primary embodiment of the invention, fluid passes down the surface of the apparatus in thin sheets until it reaches the membrane. The fluid will follow two paths. Some fluid will tend to follow the contour of the structure and as such a substantial amount will proceed along the fin disposed at the upper edge of the opening. The remainder of the fluid will proceed down both sides of the membrane along with the debris. The fluid proceeding down both sides of the membrane will have portions of such fluid removed when the fluid follows the contour of the intermediate fins disposed in the opening. The fluid remaining with the debris will be subjected to a final separation and some amounts of the remaining fluid will follow the fin disposed at the lower edge of the opening. The fluid which is separated and follows the intermediate fins will flow on both sides of such intermediate fins. After the separation of the fluid from the debris there remains still some amount of fluid that will proceed with the debris, and this fluid will serve to flush the debris from the membrane and keep such membrane clean and unclogged. This remaining fluid is also used to flush the debris from the remainder of the surface in general.

In the second embodiment of the invention, as fluid passes down the surface of the apparatus in thin sheets, the fluid tends to follow the contour of the structure and a substantial amount of fluid will proceed along the fin disposed in the upper edge of the opening. Some fluid will proceed down both sides of the membrane along with the debris and some amounts of water remaining will be separated as a second fin disposed at lower edge of the opening. The fluid remaining will serve to flush debris from the membrane to keep it clean and unclogged and to flush debris from the surface in general.

In both embodiments of the present invention, it can be utilized in an eaves trough or gutter system such that there is a substantial amount of collection of water or other fluid running off a roof. Although the water is collected, the debris will be washed from the roof along with a small amount of water dispelled from the gutter system with the debris. Additionally, the present invention can be incorporated in a down flow filtering system.

When the primary embodiment of the invention is used in the downflow system, there are a plurality of surfaces having an opening, fins disposed at the upper and lower edges of said opening, intermediate fins disposed in the opening and a membrane disposed across the opening such that there are fluid collection separations on various levels. In the system, the surfaces are substantially vertically disposed such that there is a fluid and debris separation on different level until the fluid is received by fluid collection members for transportation from the system.

In the secondary embodiment of the down flow system, there is a plurality of surfaces having openings, fins, and a membrane disposed across the opening such that there are fluid collection and separation on various levels. Also, as in the primary embodiment of the system, the surfaces are vertically disposed such that there is fluid and debris separation on different levels until the fluid is received by a fluid collection member for transfer from the system.

An object of the present invention is to provide a passive diversionary fluid collection and debris separation apparatus.

Another object of the present invention is to provide an apparatus where the permeability of a membrane can adjust the amount of fluid to be used to flush a surface.

A further object of the present invention is to provide an apparatus for attachment to a roofing system which will not clog and provide for passive diversionary fluid collection and debris separation.

A still further object of the present invention is to provide a system in which there are multiple diversionary fluid collecting and debris separating levels such that a continuing filtering of a fluid containing debris can take place.

DETAILED DESCRIPTION OF THE DRAWINGS

Figure 1:
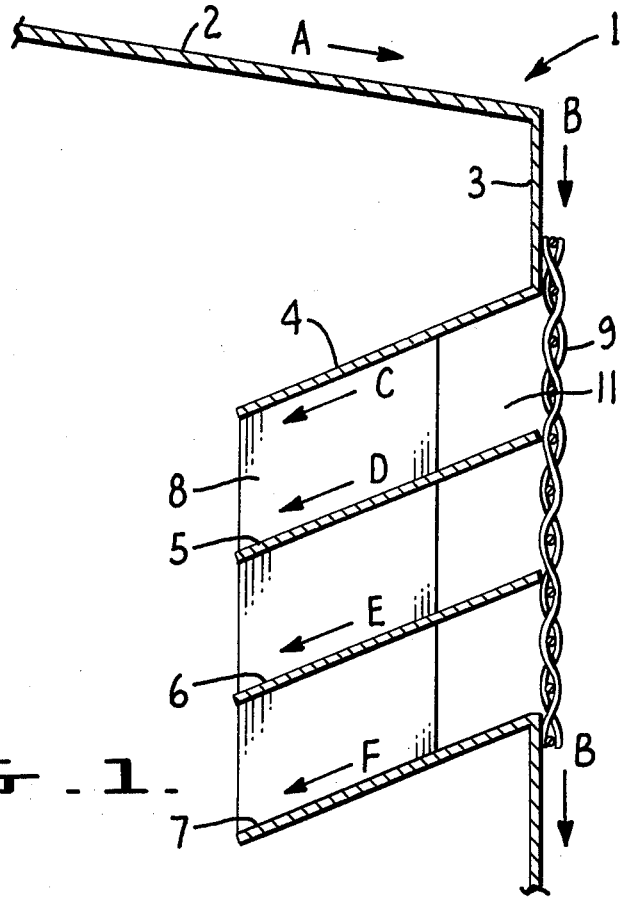
FIG. 1 shows a side view of the primary embodiment of the passive diverionary fluid collecting and separating apparatus.

The present invention is a passive diversionary fluid collecting and debris separating apparatus, where the primary embodiment of the invention is shown in FIG. 1 generally at 1. The apparatus has various uses, such as a non-clogging eaves trough or gutter for a roofing system or in a gravity flow filtering system.

Figure 2:
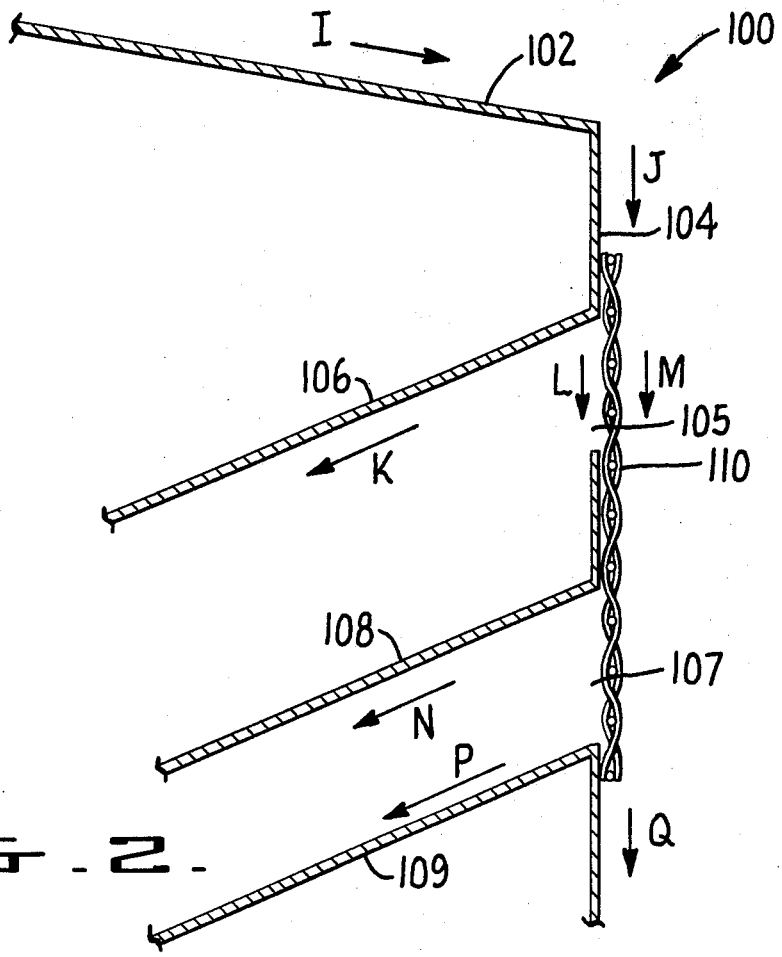
FIG. 2 shows a side view of the secondary embodiment of the passive diversionary fluid collecting and separating apparatus.

A secondary embodiment of the invention is shown in FIG. 2, generally at 100. The secondary embodiment like the primary embodiment can be used in a non-clogging eaves trough or gutter system for a roof or in a gravity flow filtering system. In both embodiments of the invention the apparatus separates debris from fluid. The apparatus can separate various sizes of debris. A substantial amount of fluid is separated and collected in one place and debris continues down the face of the apparatus and is flushed from the apparatus by a portion of the fluid.

Referring to FIG. 1, the primary embodiment of the apparatus is generally shown at 1. The apparatus has an upper end angled surface 2 which has means connected to vertical surface 3. Vertical surface 3 has thereon disposed opening 11. Opening 11 has fin 4 disposed at an upper edge and fin 7 disposed at a lower edge. Intermediate fins 5 and 6 are disposed within the opening and abut membrane 9 disposed across opening 11. The intermediate fins 5 and 6 are held in position by web 8 with means attached to fins 4, 5, 6 and 7. Although surface 3 is shown to be vertical in FIG. 1, it does not necessarily have to be so. The surface 3 can be disposed such that it forms an acute angle with the horizontal plane and still function properly.

Membrane 9 can be either disposed over opening 11 or in opening 11. At either dispositions of membrane 9, the invention will function properly. The membrane 9 can have various degrees of permeability. It is the contemplation of the inventor that these different types of permeability of membrane 9 be used for providing an adequate amount fluid necessary for properly flushing debris from the surface of the membrane 9 and surface 3.

In referring to the membrane, what is meant by stating that the membrane can be permeable or semi-permeable and still function properly is that the permeability is directed only to controlling the amount of water which flows past the collection portion and that necessary for flushing the surface. The membrane 9 can also be mobile or immobile. By stating that the membrane is immobile it is meant that it would be fixedly attached to the surface 3 across opening 11. The membrane when mobile means that it can be moved quickly and easily across the face of surface 3 so as to change the membranes disposed over opening 11. The changing of the membrane is accomplished by means not shown in the drawings.

Referring to FIG. 2, the secondary embodiment of the apparatus is shown, generally at 100. The apparatus here has an upper angled surface 102 which has means connected to the vertically disposed surface 104. Although surface 104 is shown to be vertical in FIG. 2, it does not necessarily have to be so. The surface 4 can be disposed such that it forms any acute angle with a horizontal plane and still function properly.

In FIG. 2, surface 104 has openings 105 and 107 and disposed at the upper edges of openings 105 and 107 are fins 106 and 108, respectively with fin 109 being disposed at the lower edge of the opening 107. Disposed across the openings is membrane 110 which can be either disposed over the openings 105 and 107 or individual membranes disposed in the respective openings 105 and 107.

The primary embodiment of the invention, as shown in FIG. 1, when operating, thin sheets of fluid move in direction "A" down surface 2. The fluid when traveling along upper surface 2 has debris disposed within the fluid. The thin sheets of fluid reach surface 3 and experience a vertical drop in direction "B". Upon reaching membrane 9, the fluid and debris begin the separation process.

A substantial amount of fluid follows fin 4 for collection of such fluid. The remainder of the fluid can be used to wash the debris down membrane 9. The fluid accompanying the debris flows on both sides of membrane 9. Upon fluid and debris reaching fin 5, some of the fluid remaining with the debris will be separated from such debris and travel in direction "D" on both sides of fin 5. Some fluid will continue down both sides of the membrane 9 with the debris on the outside surface of membrane 9. Upon some of the fluid reaching fin 6, some of the fluid will separated from the debris in fluid traveling along membrane 9 and will move in direction "E" on both sides of fin 6. There will still remain some fluid travelling along membrane 9 with the debris. This fluid will continue down until reaching fin 7. At fin 7, some of the fluid will be separated from the debris and will proceed in direction "F" for collection on one surface of fin 7. The remainder of the fluid and debris will leave membrane 9 and proceed down the rest of the way of surface 3 for removal from the system.

When the secondary embodiment of the invention is in operation, thin sheets of fluid move in direction "I" down upper surface 102. The fluid, while traveling along upper surface 102, has debris disposed in the fluid. The thin sheet of fluid reaches surface 104 and experiences a vertical drop in direction "J". Upon reaching the membrane 110, the fluid and debris begin to separate.

As the fluid continues down surface 104 after contacting the membrane 110, a substantial amount of fluid will proceed along fin 106 in direction "K" for collection due to the tendency of the fluid to follow the fin. A smaller amount of fluid will flow on both sides of membrane 110 and continue along surface 104. As the fluid passes along both sides of membrane 110, the debris is washed along the membrane with the fluid.

The substantial amount of the remaining fluid after the first separation, will then be separated from the debris and will pass along fin 108 in direction "N". The fluid traveling in direction "L" and "M" will move in and out of the membrane 110 with separation at fin 108. Some of the fluid remaining with the debris will follow in and out of membrane 110 and there will be a final separation of the fluid at fin 109 disposed at the lower end of opening 107. The fluid separated at fin 109 will travel in direction "P" for collection. Any fluid remaining will proceed in direction "Q" and leave the surface 104 with the debris.

Figure 3:
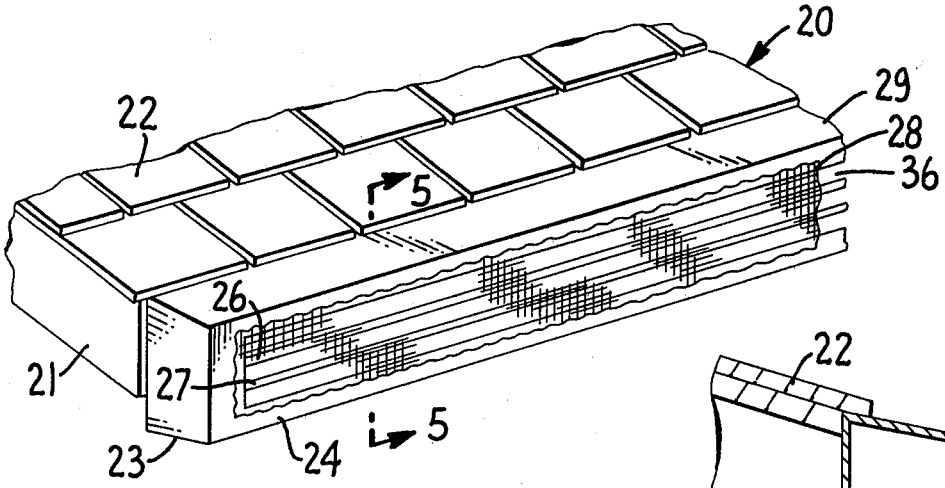
FIG. 3 shows an elevated view of eaves trough or gutter system incorporating the primary embodiment of the passive diversionary fluid collecting and debris separating apparatus.

FIG. 3 shows the primary embodiment of the apparatus incorporated in an elongated eaves trough or gutter system for attachment to the roofing system. The elongated enclosure 23 is connected to the roofing system. Surface 24 is thereon disposed opening 36. Disposed in or over opening 36 is membrane 28.

Figure 5:
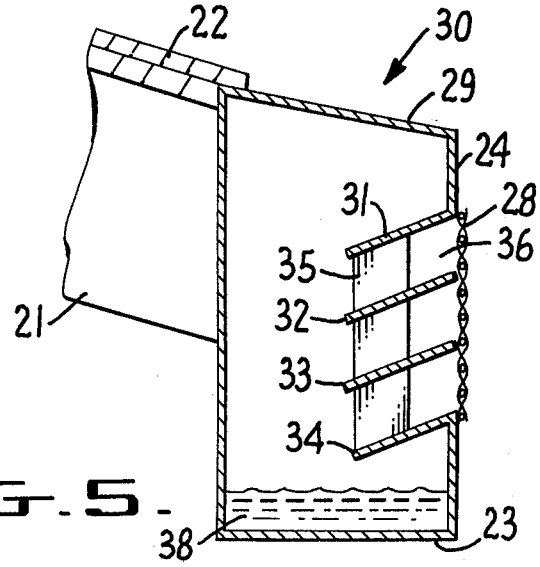
FIG. 5 shows a cross-sectional view of FIG. 3 at 5—5.

Referring to FIG. 5, generally shown at 30, a side-view of an eaves trough system employing the primary embodiment of the invention is shown. In FIG. 5 water and debris running off shingles 22 will run onto upper angled surface 29. The debris and fluid will then experience a vertical drop and proceed down the surface 24. The fluid and debris are in contact with membrane 28 disposed across opening 36. The fluid will tend to sheet on surface 29 in most cases. The gravitational force will, in many cases, cause the larger pieces of debris to be dispelled at the junction of surfaces 29 and 24. However, the smaller pieces of debris will proceed down surface 24 with the sheeting water and will be separated by membrane 28.

At the membrane 28 the first separation begins. The fluid, a substantial amount, will tend to follow the contour of fin 31 for collection in the base of elongated member 23. The fluid remaining with the debris will proceed in and out of membrane 28. The debris will generally stay on the outside of the membrane 28. As the fluid and the smaller particles of debris shall go down membrane 28, the fluid will be separated and intermediate fins 32 and 33. A fluid will travel on both sides of the respective fins. The intermediate fins 32 and 33 are held in place by web member 35 which has means connected to fins 31, 32, 33 and 34. Some of the fluid remaining with the debris after passing intermediate fins 32 and 33 will separated at fin 34. The fluid separated by fins 31, 32, 33 and 34 will be deposited in the bottom of enclosure 23 shown at 38.

Figure 4:
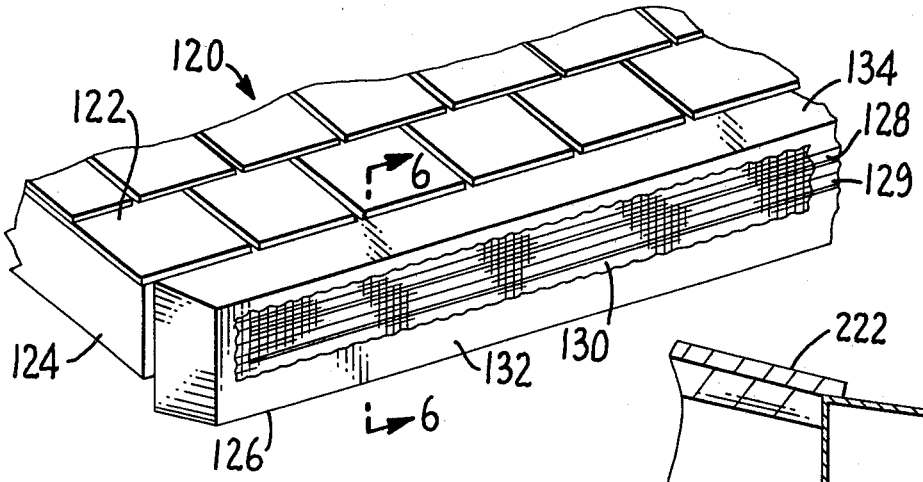
FIG. 4 shows an elevated view of an eaves trough or gutter system incorporating the secondary embodiment of the passive diversionary fluid collecting and debris separating apparatus.

In FIG. 4, the second embodiment of the invention is shown incorporated in an elongated eaves trough or gutter system for attachment to a roofing system. Elongated enclosure 126 is connected to the roofing system. Surface 132 has therein disposed two rows of elongated lateral openings 128 and 129. Disposed over, in or across openings 128 and 129 is membrane 130.

Figure 6:
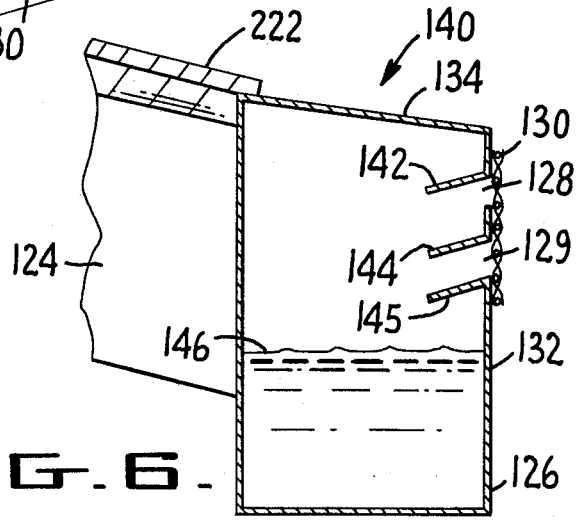
FIG. 6 shows a cross-sectional view of FIG. 4 at 6—6.

Referring to FIG. 6, generally shown at 140, the side view of the apparatus for attaching to a roofing system is shown. Water and debris running off of shingles 222 will run onto surface 134 of elongated enclosure 126 attached to the roof. The fluid will tend to sheet on surface 134 and carry the debris down along the angled surface. Upon reaching the connecting edge of surfaces 134 and 132, the sheeting water will proceed downward along surface 132. By gravitational force the larger pieces of debris may be dispelled at the junction of surfaces 132 and 134. However, the smaller pieces of debris will proceed down surface 132 with the sheeting water. Upon reaching a membrane 130, a substantial amount of the water will proceed along surface 132 and follow fin 142 for collection in the bottom of the enclosure, as shown at 146. The remainder of the water will proceed on both sides of membrane 130. The debris will be prevented from entering the collection area by the membrane 130. The fluid traveling on both sides of membrane 130 will serve to flush the membrane and keep the debris moving along the surface 132. A substantial portion of the remaining fluid traveling along surface 132 and membrane 130 will follow fin 144 and 145 and the fluid will be collected at the bottom of enclosure 126. The fluid that remains on membrane 130 will continue down surface 132 with the debris and flush surface 132 free of the debris, with the substantial amount of the fluid being collected in the base of enclosure 126 for removal from the system.

Figure 7:
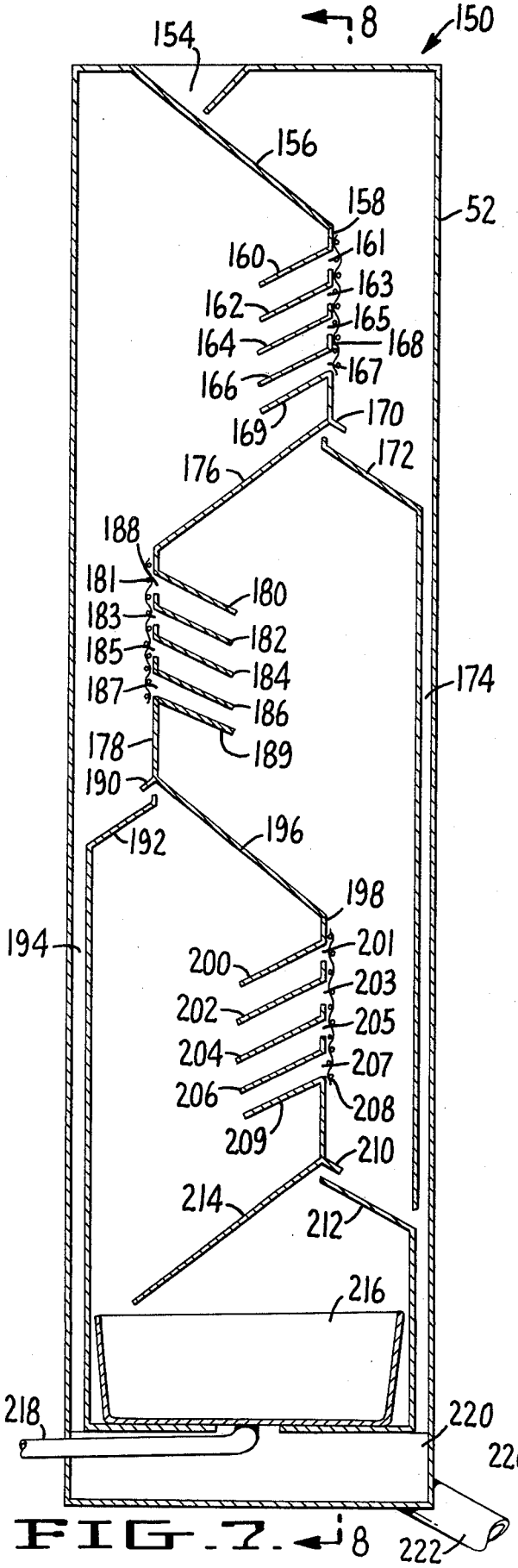
FIG. 7 shows a plurality of passive diversionary fluid collecting and debris separating apparatuses in substantial vertical alignment in a filtering system.
Figure 8:
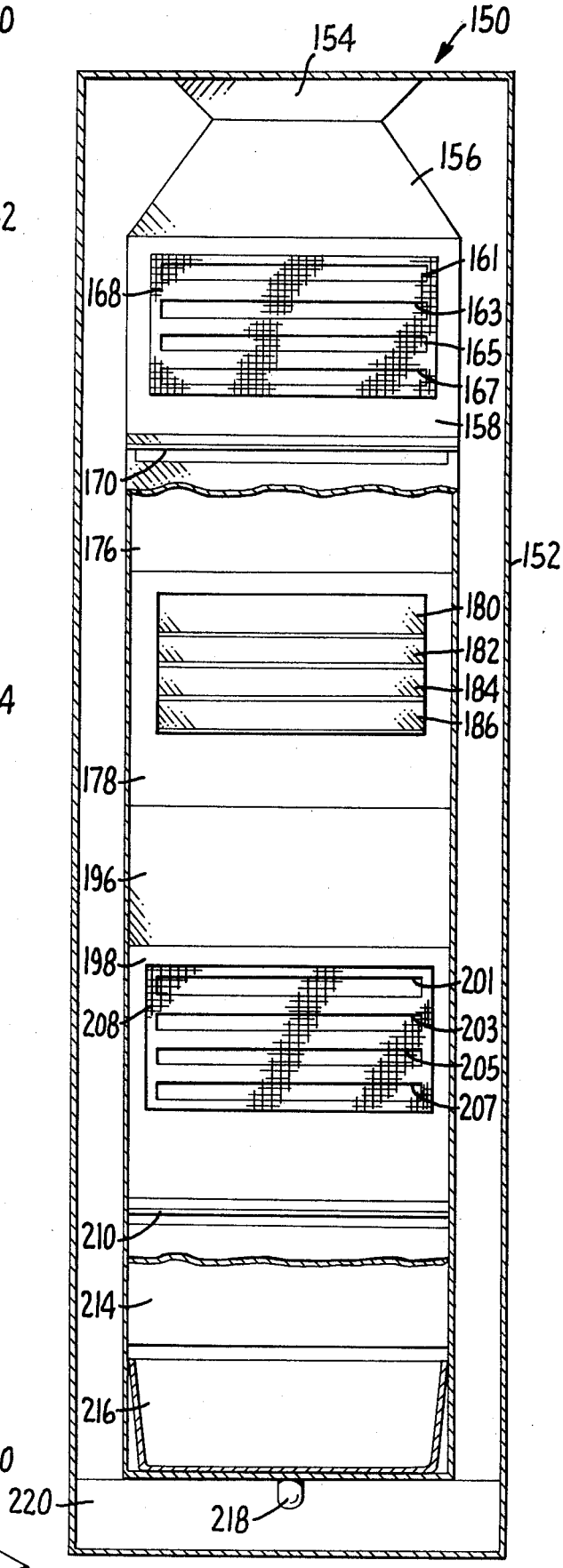
FIG. 8 shows a front view of the apparatus of FIG. 7 at 8—8.

Referring to FIGS. 7 and 8, a filter system is shown generally at 150 incorporating several diversionary fluid collecting and debris separating apparatuses as in the secondary embodiment of the invention. Either embodiment of the invention can be used. However, the secondary embodiment is herein described for use in the filtering system.

In the system, generally shown at 150, a fluid with debris contained therein, is placed into opening 154 at the top. Opening 154 is in fluid communication with the surface 156 which, because of its angled nature, will cause the fluid with the debris to form a thin sheet over surface 156. Upon the fluid and debris leaving surface 156, it will proceed down surface 158 which contains the openings 161, 163, 165 and 167. Disposed across the openings is a membrane 168. Additionally, disposed at the upper edge of each of the openings are fins 160, 162, 164 and 166, respectively with fin 169 disposed at the lower edge of opening 167. As set forth previously, the fins along with the surface 158 form obtuse angles when disposed at the upper edge and an acute when disposed at a lower edge. The fluid proceeding down surface 158 will separate from the debris and in succession fluid will travel along fins 160, 162, 164, 166 and 169 for passage to the second stage. As was described previously, a small amount of fluid will proceed down both sides of membrane 168 with the debris after separation from the fluid. The debris with a small amount of fluid will proceed down the remainder of surface 158 to angled end 170. At angled end 170, the debris with the fluid will drop to surface 172 which is in communication with debris channel 174 which communicates with debris collection area 220. From debris collection area 220 the debris is dispelled from the system via a pipe 222.

After the fluid has been separated from the first apparatus, the fluid will fall from fins 160, 162, 164, 166 and 169 onto angled surface 176. The fluid may still contain some level of debris which was not separated during the first separating operation. The fluid falling to surface 176 will again sheet and proceed to surface 178. Upon proceeding down surface 178, the fluid with possible levels of debris will be subject to separation for a second time. A substantial amount of fluid will be separated and will follow fins 180, 182, 184 and 186 which are disposed at the upper edges of openings 181, 183, 185 and 187 respectively and 189 at the lower edge of opening 187.

The debris remaining in the fluid after the first operation will be separated in subsequent operations. The debris will be washed or flushed down surface 178 by the small amount of fluid. The small amount of fluid will flow along both sides of membrane 188 along with some amounts of the debris. As previously stated, the small amount of fluid flushes surface 178 and enables the debris to be dispelled from the surface. The membrane 188 can be of the same level of permeability as membrane 168 in the first operation. However, the membrane can be of less or more permeability dependent upon the choice.

Once the debris and small amount of fluid pass membrane 188, it is flushed down the remainder of surface 178 to angled end 190. At angled end 190, the fluid and debris will pass to angled surface 192 which is in communication with debris channel 194. Debris channel 194 is in communication with debris collection area 220 at the base of the system. The debris passing from 194 to 220 can then be dispelled from the system through pipe 222.

The substantial amount of fluid separated in the second operation proceeds along fins 180, 182, 184, 186 and 189 will drop onto angled surface 196. Upon dropping onto angled surface 196 the fluid will again sheet on the surface and will proceed to the surface 198 which has openings 201, 203, 205 and 207. The fluid will, at this point, go through a third separation operation. The fluid which passes to surface 198 will be separated from any remaining debris contained in the fluid and a substantial amount of the fluid will be separated and proceed down fins 200, 202, 204, 206 and 209 for collection. Also, in this operation the debris separated by membrane 208 will be flushed down surface 198 by small amounts of fluid from the original amount that entered this stage. As stated for membrane 188, membrane 208 can be of a different permeability from any of the membranes as previously mentioned. The small amount of fluid accompanying the debris will pass along both sides of membrane 208 and flush surface 198 free of debris. The debris and the small amount of fluid will proceed down the remainder of surface 198 to end 210. From 210 the debris, with the small amount of fluid, will drop to angled surface 212. From surface 212, the debris and the small amount of fluid will pass to debris channel 174 for passage to debris collection area 220. As previously stated, the debris from collection area 220 can be expelled from the apparatus via pipe 222.

The substantial amount of fluid separated from the debris proceeds along fins 200, 202, 204, 206 and 209 will drop to angled surface 214. The fluid after passing along angled surface 214 will enter fluid collection area 216. Once the fluid enters 216, it can be removed from the system via pipe 218.

Although there are only three separation operations shown in the apparatus at 150, this is not to be construed as a limitation for multiple operations using the passive diversionary fluid collecting and debris separating apparatus. There can be many more apparatuses in this off-set vertical arrangement or relationship and still be within the contemplation of the invention.

The inventor contemplates other embodiments using multiple passive diversionary fluid collecting and debris separating apparatus. There can be a greater number than shown in FIGS. 7 and 8 in their offset vertical relationship. Additionally, the multiple apparatuses can be disposed laterally such that there would be a plurality of columns of multiple apparatuses in the vertical offset relationship.

The passive diversionary fluid collecting and separating apparatus can be constructed of various types of materials. The basic structural apparatus, that being the surface containing the openings with the fins disposed at the upper and/or lower edge of the openings and a membrane across the openings, can be constructed of conventional metal or plastic materials. In a primary embodiment of the invention, it is contemplated that the entire structure would be constructed of a plastic type material. However, this will not preclude the use of metal or other material for the construction of the apparatus.

The membrane can either be constructed of the same material as the basic structure or of a different material.

As previously stated, the membrane can be disposed over the openings or in the openings. When the construction is such that the membrane is disposed in the opening, it is usually easier and more efficient to construct the membrane out of the same material as the surface and fins. In circumstances where the membrane is disposed over the openings, it can be made of the same or a different material.

The non-clogging eaves trough and gutter system can have all components constructed of the same or different material.

The plurality of passive diversionary fluid collecting and debris separating apparatuses as shown in the system in FIGS. 7 and 8 can all be constructed of the same or different material. The remainder of the structure is not limited as to the material to be used, however, it is contemplated that the actual plurality of apparatus be constructed of a plastic type material.

In order to provide flexibility for the use of the apparatus and the possible changing nature of the debris to be separated from some fluid, the membrane disposed over the openings as well as being immobile and fixed to the surface containing the openings can be mobile. Although, it is not shown in any of the drawings, the membrane can be disposed on feed and pick-up reels such that the reels would be disposed on either side of the apparatus and when desired the membrane disposed across a specific set of openings can be readily and easily changed.

The use of a mobile membrane is an important part of the invention, simply because if it is desired to have separation of smaller particles of debris, a less permeable membrane can be easily placed in front of the opening by simply reeling the membrane in such a way that the membrane of the desired permeability is in front of the opening of the surface. Although, there is made reference to reeling the membrane such that a new membrane can be placed across the openings of the surface, any conventional means to move or change a membrane across the openings is contemplated.

The mobility of the membrane is also contemplated to provide the ability to adjust the amount of fluid available to flush the surface. This is highly desirable where it is required to separate large pieces of debris which require more flushing fluid to flush the surface.

The feature of the mobility of the membrane across the opening also encompasses moving just a new piece of membrane in front of the opening. The membrane could have been in place for a while and just become old, worn or obstructed and in need of replacement. In such cases it is contemplated that the membrane be reeled or some other useful means used to move a new membrane in across the openings.

The inventor contemplates the invention to be all that is shown, described, disclosed and claimed to be the invention. However, there can be various adaptations and alterations to the present invention as shown, disclosed and described. The inventor thus contemplates the invention to be all that is shown, disclosed, described and claimed and all equivalents thereto.

I claim:

1. A passive diversionary fluid and debris separating apparatus for a roof system comprising:

a first planar member extending substantially vertically downward with respect to the roof system, said planar member having inner and outer surfaces, with the outer surface defining the initial downward path of travel of fluid and debris from said roof system along said planar member, said planar member including at least one opening formed therein;

a fluid permeable planar membrane, said membrane being vertically disposed and covering said opening in said planar member;

at least one fin extending inwardly and downwardly from said permeable member, such that a portion of the fluid travelling down said membrane is drawn off by said fin, thereby diverting fluids from the outer surface of said member to the inner surface thereof for collection.

2. An apparatus as recited in claim 1 further including a collection means for capturing fluid diverted by said fin.

3. An apparatus as recited in claim 2 wherein said planar member forms a portion of an enclosure and wherein said collection means is disposed within said enclosure.

4. An apparatus as recited in claim 1 wherein a pair of fins are provided, with an upper fin extending inwardly and downwardly from the upper edge of said opening and a lower fin extending inwardly and downwardly from the lower edge of said opening.

5. An apparatus as recited in claim 4 further including an additional fin extending inwardly and downwardly from said permeable member and disposed between said upper and lower fins.

6. An apparatus as recited in claim 1 wherein said fluid permeable membrane is removably mounted to the opening formed in said planar member.

* * * * *